US006931728B2

(12) United States Patent
Howard et al.

(10) Patent No.: US 6,931,728 B2
(45) Date of Patent: Aug. 23, 2005

(54) TEST MODEL FOR A GAS TURBINE COMBUSTOR DOME AND METHOD OF FABRICATING

(75) Inventors: Edward Lee Howard, Cincinnati, OH (US); Gilbert Farmer, Cincinnati, OH (US); James Hollice Poynter, Hamilton, OH (US); Ronald Lee Sheranko, Cincinnati, OH (US); John Robert Staker, Cincinnati, OH (US); Thomas Carl Mills, Cincinnati, OH (US); Gregory Thomas Lucas, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 186 days.

(21) Appl. No.: 10/248,128

(22) Filed: Dec. 19, 2002

(65) Prior Publication Data

US 2004/0154152 A1 Aug. 12, 2004

(51) Int. Cl.[7] ..... B21D 53/00; F02C 1/00

(52) U.S. Cl. ..... 29/890.01; 29/428; 29/464; 29/469; 29/889.22; 60/754; 60/756

(58) Field of Search ..... 29/428, 464, 469, 29/888.01, 889.2, 889.21, 889.22, 890.01; 60/754, 756

(56) References Cited

U.S. PATENT DOCUMENTS 4,008,568 A * 2/1977 Spears, Jr. et al. ..... 60/796
4,208,774 A * 6/1980 Voyer et al. ..... 29/888.01
4,232,527 A * 11/1980 Reider ..... 60/754
4,843,825 A * 7/1989 Clark ..... 60/756
5,329,761 A * 7/1994 Ablett et al. ..... 60/804
6,212,870 B1 * 4/2001 Thompson et al. ..... 60/772
6,298,667 B1 * 10/2001 Glynn et al. ..... 60/737
6,314,739 B1 * 11/2001 Howell et al. ..... 60/748
6,442,940 B1 * 9/2002 Young et al. ..... 60/748
6,453,671 B1 9/2002 Leen et al. ..... 60/748
6,502,400 B1 * 1/2003 Freidauer et al. ..... 60/772
6,629,415 B2 * 10/2003 Howard et al. ..... 60/752
6,735,950 B1 * 5/2004 Howell et al. ..... 60/748

FOREIGN PATENT DOCUMENTS

EP 521687 A1 * 1/1993 ..... F23R/3/10
JP 2002031344 A * 1/2002 ..... F23R/3/42

OTHER PUBLICATIONS

U.S. Appl. No. 10/029,364, filed Oct. 27, 2001.

* cited by examiner

*Primary Examiner*—Essama Omgba
(74) *Attorney, Agent, or Firm*—David L. Narciso; Gary M. Hartman; Domenica N. S. Hartman

(57) ABSTRACT

A method of fabricating a test model of a gas turbine engine combustor dome, and the test model produced thereby. The method entails individually stamping a plurality of dome wall segments and first and second mounting band segments. Each wall segment comprises at least one cup between radially inward and outward edges of the wall segment, and an opening in the cup. At least one wall segment and its two corresponding mounting band segments are placed on a fixture that locates the opening of the wall segment, locates the first and second mounting band segments at the radially-inward and outward edges of the wall segment, and orients the wall segment to establish a dome angle of the fixtured dome assembly. The wall segment and mounting band segments are then joined while the fixtured dome assembly remains on the fixture to form at least a unitary sector of the test model.

25 Claims, 1 Drawing Sheet

TEST MODEL FOR A GAS TURBINE COMBUSTOR DOME AND METHOD OF FABRICATING

BACKGROUND OF INVENTION

1. Field of the Invention

The present invention generally relates to combustion systems of gas turbine engines. More particularly, this invention relates to a method of fabricating a gas turbine engine combustor dome suitable for use in the development and testing of a combustor.

2. Description of the Related Art

A conventional gas turbine engine of the type for aerospace and industrial applications has a combustor with an annular-shaped combustion chamber defined by inner and outer combustion liners. The upstream ends of the combustion liners are secured to a pair of mounting bands spaced radially from each other on an annular-shaped dome, which defines the upstream end of the combustion chamber. Between the mounting bands, the dome has an annular-shaped wall, typically disposed at some angle ("dome angle") to a plane perpendicular to the axis shared by the dome and combustion chamber. A number of circumferentially-spaced contoured cups are formed in the dome wall, with each cup defining an opening in which one of a plurality of air/fuel mixers, or swirler assemblies, is individually mounted for introducing a fuel/air mixture into the combustion chamber. The dome is important to the desired performance and functionality of the combustor since the dome affects the shape of the combustion chamber and the size and locations of the openings in the dome locate and affect the performance of the swirler assemblies mounted within the openings. Consequently, domes have been manufactured as a one-piece stamping to provide accuracy and consistency in the location and shape of the dome, including its cups and mounting bands.

During the development of a gas turbine engine, combustor mockups are often fabricated to perform a variety of tests, such as profile and pattern factor development, that assess the performance of a combustor and its individual components, including the aerodynamic, heat transfer and mechanical design requirements of the dome. One approach for fabricating a dome test model for development testing is to fabricate a production-type tool capable of forming the entire dome in a single stamping operation. However, a significant drawback with this approach is the large capital expense and lead times required to fabricate the tooling. Furthermore, this tooling is dedicated to a particular dome design that may be one of a number of designs evaluated before a suitable production design is identified. Another approach is to fabricate a number of individual components, such as cones, cylinder and flat plates, that can be assembled and welded together to form domes of various configurations. However, the suitability of this approach depends on the ability of the fabricator to consistently produce a relatively large number dimensionally accurate parts, which must then be carefully assembled to obtain the relative positions and orientations of the individual dome components.

In view of the above, it would be desirable if an improved method were available for fabricating a dome that is suitable for developmental testing, wherein the dome can be designed and assembled with reduced costs and shorter lead times, yet meet the stringent dimensional requirements to accurately replicate the performance of the dome design being evaluated for production.

SUMMARY OF INVENTION

The present invention provides a method of fabricating a test model of a dome for a gas turbine engine combustor, and the test model produced by the method. Dome test models of this invention can be consistently and accurately fabricated to have the configuration and dimensions of a dome desired for evaluation, yet can be designed and fabricated in far less time than if the dome were formed as a single stamping.

The method of this invention generally entails stamping a plurality of dome wall segments, each dome wall segment comprising an arcuate radially-inward edge, an arcuate radially-outward edge, at least one cup between the radially inward and outward edges, and an opening in the cup for receiving a combustor swirler assembly. Also stamped are a plurality of individual arcuate-shaped first and second mounting band segments. At least one of the dome wall segments and at least one of each of the first and second mounting band segments are then placed on a fixture to form a fixtured dome assembly. The fixture comprises means for locating the opening(s) of the dome wall segment(s) on the fixture, means for locating the first mounting band segment (s) at the radially-inward edge of the dome wall segment(s), means for locating the second mounting band segment(s) at the radially-outward edge of the dome wall segment(s), and means for orienting the dome wall segment(s) to establish a dome angle of the fixtured dome assembly. The dome wall segment(s) and the first and second mounting band segments are then joined while the fixtured dome assembly remains on the fixture to form at least a unitary sector of a dome test model.

In view of the above, the present invention provides a unitary test model of a combustor dome, in which the test model generally comprises a plurality of individually-stamped dome wall segments and individually-stamped first and second mounting band segments. Each of the first and second mounting band segments is joined to the radially-inward or radially-outward edge, respectively, of a corresponding one of the dome wall segments. The test model can be viewed as comprising a plurality of unitary sectors, with each sector comprising one or more dome wall segments and the corresponding first and second mounting band segments joined to the dome wall segment(s). This construction enables the individual components of the dome, particularly the openings for the swirler assemblies, to be accurately shaped and sized by a stamping operation, yet at the same time can make use of stamping tooling that requires far less time to design and fabricate. The relative locations of the openings of the test model are then established by the fixturing, as are the dome angle and the orientation of the mounting band segments. As such, the resulting dome test model of this invention is capable of accurately replicating the performance of a dome formed of a unitary stamping, but the lead time and costs associated with fabricating the test model are significantly less than what would be required to fabricate a unitary stamped dome, while also being less dependent on the skill of the fabricator.

Other objects and advantages of this invention will be better appreciated from the following detailed description.

DETAILED DESCRIPTION

Figure 1:
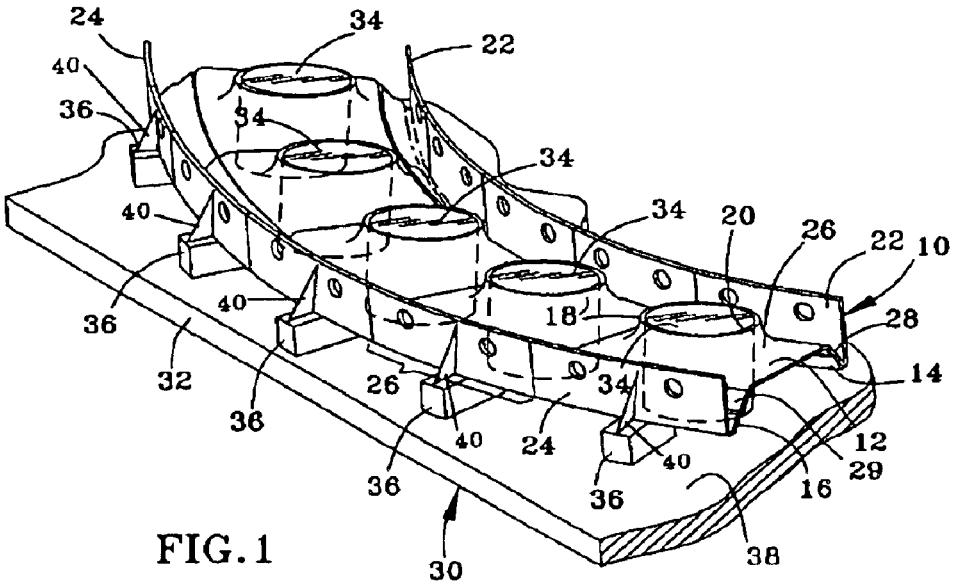
FIGS. 1 and 2 are fragmentary perspective and end views of a dome sector and a fixture on which the sector has been fabricated in accordance with this invention.
Figure 2:
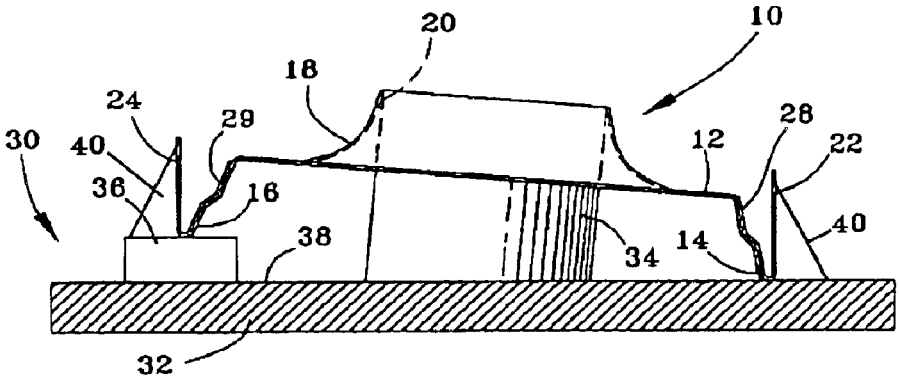

FIGS. 1 and 2 depict a unitary dome sector 10 that, when assembled with other sectors 10, forms a unitary test model of a dome for a gas turbine engine combustor. As shown, the sector 10 comprises a number of individually-stamped dome wall segments 12, with each dome wall segment 12 comprising arcuate radially-inward and outward flanges 14 and 16, a single cup 18 between the inward and outward flanges 14 and 16, and an opening 20 in the cup 18. As shown, the wall of each cup 18 is arcuate, rising above the surrounding surface of its wall segment 12 and terminating in the opening 20 that lies in a plane substantially parallel to the surrounding surface of the wall segment 12. The sector 10 further comprises a number of individually-stamped arcuate-shaped mounting band segments 22 and 24 joined to the inward and outward flanges 14 and 16, respectively, of the dome wall segments 12. For this purpose, the mounting band segments 22 and 24 are represented as having flanges 28 and 29 joined to the wall segment flanges 14 and 16, though other configurations are possible.

Together, a single dome wall segment 12 and its corresponding inner and outer mounting band segments 22 and 24 can be described as forming a single dome segment 26. In a preferred embodiment, each dome segment 26 comprises mounting band segments 22 and 24 brazed to a dome wall segment 12, while adjacent dome segments 26 are joined by welding together their adjacent dome wall segments 12, inner mounting band segments 22, and outer mounting band segments 24. The dome wall segments 12 and the mounting band segments 22 and 24 are all preferably formed of the same superalloy. An example of a suitable superalloy is a cobalt-based superalloy commercially available under the name HS188 and having a nominal composition of, by weight, Co-22Ni-22Cr-14W-0.35Si-0.10C-0.03La-3Fe (max)-1.25Mn(max). However, the benefits of this invention are applicable to combustor domes that may be formed of various high temperature materials, including nickel-based and iron-based superalloys.

Each of the dome wall segments 12 is represented as defining a single cup 18 and opening 20, which promotes the dimensional accuracy and shape of the cup 18 and opening 20 possible with a stamping operation. In contrast, the circumferential spacing of the cups 18 and openings 20 along the length of the sector 10 is determined by the manner in which the dome wall segments 12 are supported and positioned relative to each other with a fixture 30 shown in FIGS. 1 and 2. The fixture 30 is represented as comprising a baseplate 32 and a number of cylindrical members 34 that are individually received in the wall segment openings 20, each of which serves as a datum point for locating the wall segments 12 on the fixture 30. Each cylindrical member 34 is attached and oriented relative to the backplate surface 38 at an angle corresponding to the dome angle of the dome being modeled. As shown, the dome angle is other than zero, resulting in a "tipped" dome, though a dome angle of zero, resulting in a "flat" dome, is also within the scope of this invention. A number of riser blocks 36 are also shown as being attached to the surface 38 of the baseplate 32 and support the outer joint defined by each wall segment 12 and its outer mounting band segment 24. The inner joint defined by each wall segment 12 and its inner mounting band segment 22 is represented as being supported directly by the baseplate 32. The use and location of the riser blocks 36 will depend on the dome angle required by the dome being modeled. Therefore, it is foreseeable that riser blocks 36 or other suitable features could be provided that support the inner joint in addition to, or instead of, supporting the outer joint. As seen in FIG. 2, triangular-shaped gussets 40 are preferably attached to the baseplate 32 to ensure that the mounting band segments 22 and 24 are properly positioned and held against the flanges 14 and 16 of their respective wall segments 12. Following fixturing, the wall segments 12 are preferably tack-welded to their respective cylindrical members 34 and the mounting band segments 22 and 24 are preferably tack-welded to their respective riser blocks 36 and gussets 40, and these tack welds remain during the welding of the dome segments 26 and brazing of the mounting band segments 22 and 24 to the dome wall segment 12, as well as during a stress relief treatment that preferably follows the welding operation.

The method by which the sector 10 is fabricated begins with the stamping of the individual dome wall segments 12, during which the radially-inward and outward flanges 14 and 16 of the segments 12, the cups 18 and the openings 20 within the cups 18 are formed. Suitable stamping techniques and materials and methods for fabricating a die capable of forming the wall segment 12 are known to those skilled in the art, and therefore will not be discussed here in any detail. The mounting band segments 22 and 24 are also preferably fabricated with a stamping operation. The dome wall segments 12 and their corresponding mounting band segments 22 and 24 are then placed on the fixture 30, as depicted in FIGS. 1 and 2, to yield what may be termed a fixtured dome assembly. When properly positioned on the fixture 30, the openings 20 of the dome wall segments 12 are located on the fixture 30 with the cylindrical members 34, and the riser blocks 36 and gussets 40 support and locate each inner and outer mounting band segment 24 at the corresponding inward and outward flange 14 and 16, respectively, of its dome wall segment 12. As noted above, the wall segment 12 and the band segments 22 and 24 are then preferably tack welded to the cylindrical members 34, riser blocks 36 and gussets 40 to positively position the wall segments 12 and the band segments 22 and 24 on the fixture 30. A suitable tack weld for this purpose is about 0.05 to 0.10 inch (about 1.3 to about 2.5 mm) in diameter. In the configuration shown in FIG. 2, the riser blocks 36 support the outer radial flanges 16 of the dome wall segments 12 out of the plane of the baseplate surface 38, causing the dome wall segments 12 to be disposed at an angle to the baseplate surface 38 that will result in the sector 10 being disposed at the proper dome angle for the dome being modeled.

After fixturing the components of the sector 10 in the above-described manner, adjacent dome wall segments 12 are welded together, adjacent inner mounting band segments 22 are welded together, and adjacent outer mounting band segments 24 are welded together. A suitable welding technique is electron beam or laser welding, with or without a filler material, though other welding techniques (e.g., tungsten inert gas, or TIG) could potentially be used. As noted above, the wall segments 12 and mounting band segments 22 and 24 are preferably stress relieved following welding by subjecting the entire fixtured assembly to a heat treatment appropriate for the materials used to form the wall and band segments 12, 22 and 24 as well as the welds that join these components. To avoid the potentially detrimental effect of different physical properties, particular different coefficients of thermal expansion (CTE), the baseplate 32, cylindrical members 34, riser blocks 36 and gussets 40 of the fixture 30 are all preferably formed of the same material as the wall and band segments 12, 22 and 24.

Following heat treatment, the welded mounting band segments 22 and 24 are then brazed as a unit to the welded dome wall segments 12, with each band segment 22 and 24 being individually brazed to its respective dome wall segment 12 while the fixtured dome assembly remains on the fixture 30, the result of which is the unitary sector 10.

Suitable braze alloys for use with this invention include various high-temperature nickel-based alloys that are commercially available. To prevent brazing of the wall and band segments 12, 22 and 24 to the fixture 30, a suitable braze inhibitor paste such as STOPOFF®, commercially available from Pyramid Plastics, Inc., can be used. Thereafter, the sector 10 can be welded to an appropriate number of identically-fabricated sectors to form a unitary test model of a dome. In practice, the five-cup sector 10 represented in FIG. 1 is one of several identical sectors that can be welded together to form a unitary dome test model. Alternatively, the sector 10 could consist of a single dome segment 26 formed of a dome wall segment 12 and its two mounting band segments 22 and 24 joined thereto. Yet another alternative is that the entire unitary dome test model could be fabricated in the manner described above by manufacturing the fixture 30 to accommodate enough dome segments 26 to form the desired test model. In any case, the test model can then be used in a developmental test conducted to evaluate the dome design.

While the invention has been described in terms of a preferred embodiment, it is apparent that other forms could be adopted by one skilled in the art. For example, the physical configuration of the dome test model and fixture 30 could differ from that shown. For example, while the Figures show a single annular combustor dome being modeled, the fixture could be adapted to model a multidome combustor having two or more concentric domes. Therefore, the scope of the invention is to be limited only by the following claims.

What is claimed is:

1. A method of fabricating a test model of a dome for a gas turbine engine combustor, the method comprising the steps of:

stamping a plurality of dome wall segments, each dome wall segment comprising an arcuate radially-inward edge, an arcuate radially-outward edge, at least one cup between the radially inward and outward edges, and an opening in the cup;

stamping a plurality of arcuate-shaped first mounting band segments and a plurality of arcuate-shaped second mounting band segments;

placing at least one of the dome wall segments and at least one of each of the first and second mounting band segments on a fixture to form a fixtured dome assembly, the fixture comprising means for locating the opening of the at least one dome wall segment relative to the fixture, means for locating each of the at least one first mounting band segment at the radially-inward edge of the at least one dome wall segment, means for locating each of the at least one second mounting band segment at the radially-outward edge of the at least one dome wall segment, and means for orienting the at least one dome wall segment to establish a dome angle of the fixtured dome assembly; and then joining the at least one dome wall segment and the at least one first and second mounting band segments while the fixtured dome assembly remains on the fixture to form at least a unitary sector of a dome test model.

2. A method according to claim 1, further comprising the step of joining a plurality of unitary sectors to form a unitary dome test model.

3. A method according to claim 2, wherein the step of joining a plurality of unitary sectors comprises a welding operation.

4. A method according to claim 1, wherein the joining step comprises joining one of the dome wall segments and one of each the first and second mounting band segments to form the unitary sector.

5. A method according to claim 4, further comprising the step of joining a plurality of unitary sectors together to form a unitary dome test model.

6. A method according to claim 1, wherein the joining step comprises joining a plurality of the dome wall segments and a plurality of the first and second mounting band segments to form the unitary sector.

7. A method according to claim 6, further comprising the step of joining a plurality of unitary sectors together to form a unitary dome test model.

8. A method according to claim 1, wherein the joining step comprises joining a plurality of the dome wall segments and a plurality of the first and second mounting band segments to yield a unitary dome test model at the completion of the joining step.

9. A method according to claim 1, wherein the joining step comprises:

welding a plurality of the dome wall segments together, welding a plurality of the first mounting band segments and welding a plurality of the second mounting band segments together; and then brazing the welded dome wall segments to the welded first and second mounting band segments to form the unitary sector.

10. A method according to claim 9, further comprising the step of performing a stress-relieving heat treatment between the welding and brazing steps.

11. A method according to claim 1, wherein the fixture comprises a baseplate, and the means for locating the opening comprises a cylindrical member attached to the baseplate and sized to center the opening.

12. A method according to claim 1, wherein the fixture comprises a baseplate, and the means for locating the second mounting band segments and the means for establishing the dome angle comprises blocks attached to the baseplate.

13. A method according to claim 1, wherein the dome wall segments, the first and second mounting band segments, and the fixture are formed of the same material.

14. A method according to claim 1, further comprising the step of conducting a developmental test on the dome test model.

15. A method of fabricating a test model of a dome for a gas turbine engine combustor, the method comprising the steps of:

stamping a plurality of dome wall segments, each dome wall segment comprising an arcuate radially-inward flange, an arcuate radially-outward flange, a single cup between the radially inward and outward flanges, and a single opening in the cup;

stamping a plurality of arcuate-shaped first mounting band segments and a plurality of arcuate-shaped second mounting band segments;

providing a fixture comprising a baseplate, a plurality of cylindrical members attached and oriented at an angle to a first surface of the baseplate, a plurality of blocks and gussets attached to the first surface of the baseplate, the baseplate, the cylindrical members, the blocks and the gussets being formed of the same material;

placing more than one of the dome wall segments and more than one of each of the first and second mounting band segments on the fixture to form a fixtured dome assembly, the openings of the dome wall segments being located on the fixture with the cylindrical members, the blocks, the gussets and the first surface of the baseplate cooperating to locate the first mounting band segments at the radially-inward flanges of the dome wall segments and the second mounting band segments at the radially-outward flanges of the dome wall segments, and to orient the dome wall segments to establish a dome angle of the fixtured dome assembly;

tack welding the dome wall segments to the cylindrical members and the blocks and the gussets to the first and second mounting band segments;

welding adjacent dome wall segments together, welding adjacent first mounting band segments together, and welding adjacent second mounting band segments together while the fixtured dome assembly remains on the fixture; and then brazing each of the first and second mounting band segments to their respective dome wall segments while the fixtured dome assembly remains on the fixture to form a unitary sector of a dome test model.

16. A method according to claim 15, further comprising the step of stress relieving the dome wall segments and the first and second mounting band segments following the welding step and while the fixtured dome assembly remains on the fixture.

17. A method according to claim 15, wherein the dome wall segments, the first and second mounting band segments, and the fixture are formed of the same material.

18. A method according to claim 15, wherein the dome wall segments, the first and second mounting band segments, and the fixture are formed of a superalloy.

19. A method according to claim 15, further comprising the step of conducting a developmental test on the dome test model.

20. A unitary test model of a dome for a gas turbine engine combustor, the unitary test model comprising:

a plurality of individually-stamped dome wall segments, each dome wall segment comprising an arcuate radially-inward flange, an arcuate radially-outward flange, at least one cup between the radially inward and outward flanges, and an opening in the cup;

a plurality of individually-stamped arcuate-shaped first mounting band segments, each of the first mounting band segments being joined to the radially-inward flange of a corresponding one of the dome wall segments; and a plurality of individually-stamped arcuate-shaped second mounting band segments, each of the second mounting band segments being joined to the radially-outward flange of a corresponding one of the dome wall segments.

21. A unitary test model according to claim 20, wherein the first and second mounting band segments are brazed to the dome wall segments.

22. A unitary test model according to claim 20, wherein adjacent dome wall segments are welded together, adjacent first mounting band segments are welded together, and adjacent second mounting band segments are welded together.

23. A unitary test model according to claim 20, wherein the dome wall segments and the first and second mounting band segments are formed of the same material.

24. A unitary test model according to claim 20, wherein the dome wall segments and the first and second mounting band segments are formed of a superalloy.

25. A unitary test model according to claim 20, wherein each of the dome wall segments comprises a single cup and a single opening in the cup.

* * * * *